US008998577B2

(12) United States Patent
Gustafson et al.

(10) Patent No.: US 8,998,577 B2
(45) Date of Patent: Apr. 7, 2015

(54) TURBINE LAST STAGE FLOW PATH

(75) Inventors: Ross James Gustafson, Greenville, SC (US); Gunnar Leif Siden, Greenville, SC (US)

(73) Assignee: General Electric Company, Schenectady, NY (US)

( * ) Notice: Subject to any disclaimer, the term of this patent is extended or adjusted under 35 U.S.C. 154(b) by 670 days.

(21) Appl. No.: 13/288,057

(22) Filed: Nov. 3, 2011

(65) Prior Publication Data

US 2013/0115075 A1 May 9, 2013

(51) Int. Cl.

| | |
|---|---|
| ***F04D 29/54*** | (2006.01) |
| ***F01D 9/04*** | (2006.01) |
| ***F01D 5/14*** | (2006.01) |

(52) U.S. Cl.

CPC ..... *F01D 9/041* (2013.01); *F01D 5/142* (2013.01); *F05D 2220/3215* (2013.01)

(58) Field of Classification Search

CPC ..... F01D 5/142; F05D 2220/3215
USPC ..... 415/192, 193, 198.1, 208.1
See application file for complete search history.

(56) References Cited

U.S. PATENT DOCUMENTS

| | | | | |
|---|---|---|---|---|
| 3,475,108 | A * | 10/1969 | Zickuhr | 415/194 |
| 4,080,102 | A * | 3/1978 | Schwab | 416/223 A |
| 6,779,973 | B2 | 8/2004 | Ito et al. | |
| 7,901,179 | B2 * | 3/2011 | Senoo et al. | 415/192 |
| 2002/0098082 | A1 * | 7/2002 | Ito et al. | 415/191 |

* cited by examiner

*Primary Examiner* — Dwayne J White
*Assistant Examiner* — Jason Fountain
(74) *Attorney, Agent, or Firm* — Sutherland Asbill & Brennan LLP

(57) ABSTRACT

The present application thus provides a gas turbine engine. The gas turbine engine may include a turbine and a diffuser positioned downstream of the turbine. The turbine may include a number of last stage buckets, a number of last stage nozzles, and a gauging ratio of the last stage nozzles of about 0.95 or more.

19 Claims, 3 Drawing Sheets

TURBINE LAST STAGE FLOW PATH

TECHNICAL FIELD

The present application and the resultant patent relate generally to gas turbine engines and more particularly relate to a gas turbine last stage flow path and a related diffuser inlet for optimized performance.

BACKGROUND OF THE INVENTION

Generally described, a gas turbine is driven by a flow of hot combustion gases passing through multiple stages therein. Gas turbine engines generally may include a diffuser downstream of the final stages of the turbine. The diffuser converts the kinetic energy of the flow of hot combustion gases exiting the last stage into potential energy in the form of increased static pressure. Many different types of diffusers and the like may be known.

A number of parameters are known to have an impact on overall gas turbine performance. Attempts to improve overall gas turbine performance through variation in these parameters without regard to the diffuser, however, often results in a decrease in diffuser performance and, hence, reduced overall gas turbine engine performance and efficiency.

There is thus a desire for an optimized turbine last stage flow path with consideration of the diffuser inlet profile. The combined consideration of the last stage flow path and the diffuser inlet profile should optimize overall turbine and diffuser performance.

SUMMARY OF THE INVENTION

The present application and the resultant patent thus provide a gas turbine engine. The gas turbine engine may include a turbine and a diffuser positioned downstream of the turbine. The turbine may include a number of last stage buckets, a number of last stage nozzles, and a gauging ratio of the last stage nozzles of about 0.95 or more.

The present application and the resultant patent further provide a gas turbine engine. The gas turbine engine may include a last stage of a turbine and a diffuser positioned downstream of the last stage of the turbine. The turbine may include a number of last stage buckets, a number of last stage nozzles, a flow path therethrough, and a gauging ratio of the last stage nozzles of about 0.95 or more.

The present application and the resultant patent further provide a gas turbine engine. The gas turbine engine may include a last stage of a turbine and a diffuser. The last stage of the turbine may include a number of last stage buckets, a number of last stage nozzles, a last stage flow path therethrough, and a gauging ratio of the last stage nozzles of about 0.95 or more. The last stage of the turbine also may include a radius ratio of about 0.4 to about 0.65, a degree of hub reaction of greater than about zero (0), an unguided turning angle of less than about twenty degrees (20°), and/or an exit angle ratio of less than about one (1). Other types of operational parameters may be considered herein.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
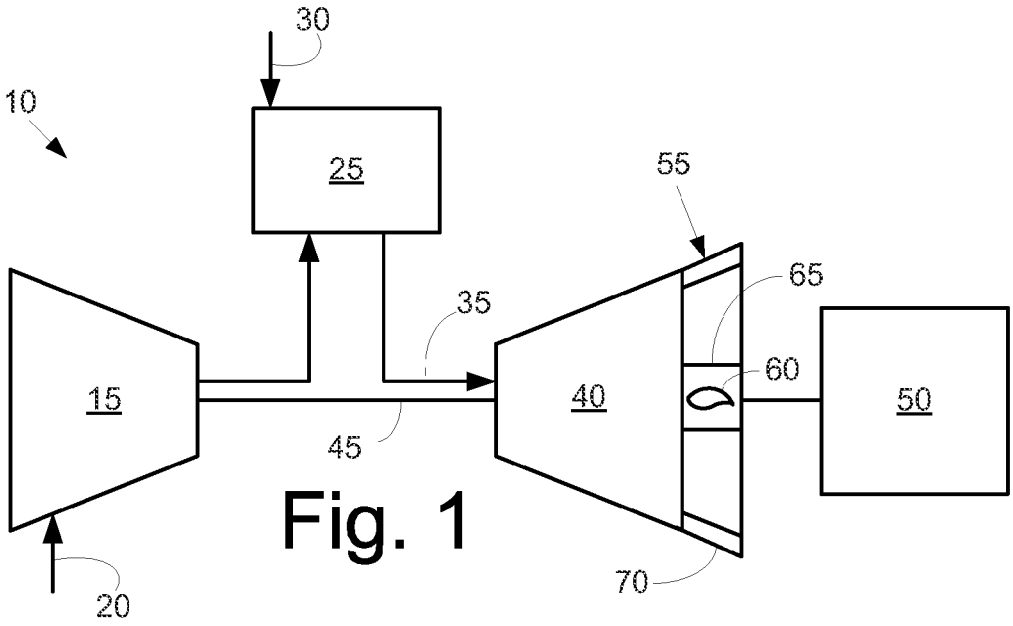
FIG. 1 is a schematic diagram of a gas turbine engine showing a compressor, a combustor, a turbine, and a diffuser.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 also may include a diffuser 55. The diffuser 55 may be positioned downstream of the turbine 40. The diffuser may include a number of struts 60 mounted on a hub 65 and enclosed via an outer casing 70. The outer casing 70 may expand in diameter in the direction of the flow. The diffuser 55 turns the flow of combustion gases 35 in an axial direction. Other components and other configurations may be used herein.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
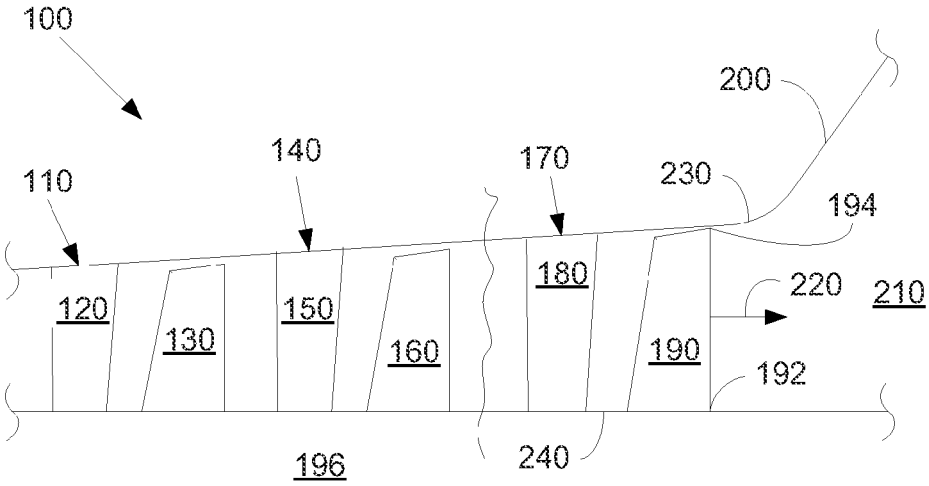
FIG. 2 is a side view of portions of a gas turbine as may be described herein.

FIG. 2 shows an example of a turbine 100 as may be described herein. The turbine 100 may include a number of stages. In this example, a first stage 110 with a first stage nozzle 120 and a first stage bucket 130, a second stage 140 with a second stage nozzle 150 and a second stage bucket 160, and a last stage 170 with a last stage nozzle 180 and a last stage bucket 190. Any number of stages may be used herein. The last stage bucket 190 may extend from a hub 192 to a tip 194 and may be mounted on a rotor 196. An inlet 200 of a diffuser 210 may be positioned downstream of the last stage 170. Generally described, the diffuser 210 increases in diameter in the direction of the flow therethrough. A last stage flow path 220 may be defined by an annulus 230 formed by an outer casing 240 of the turbine 100 adjacent to the diffuser 210. Other components and other configurations may be used herein.

Figure 3:
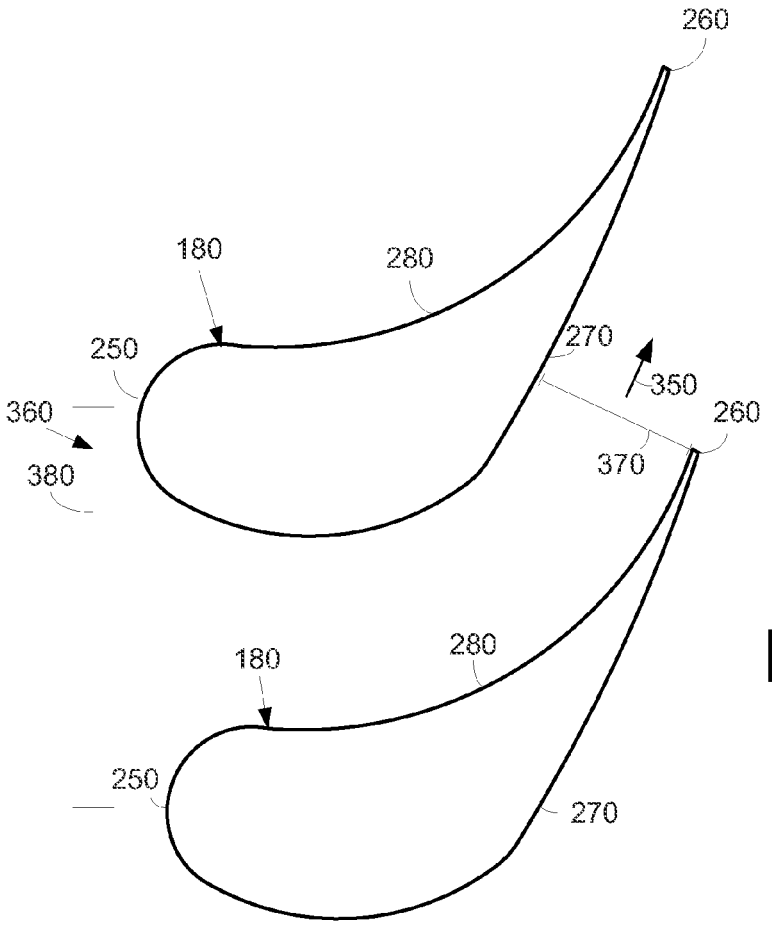
FIG. 3 is a schematic view of a portion of the turbine of FIG. 2 showing a pair of turbine nozzles.
Figure 4:
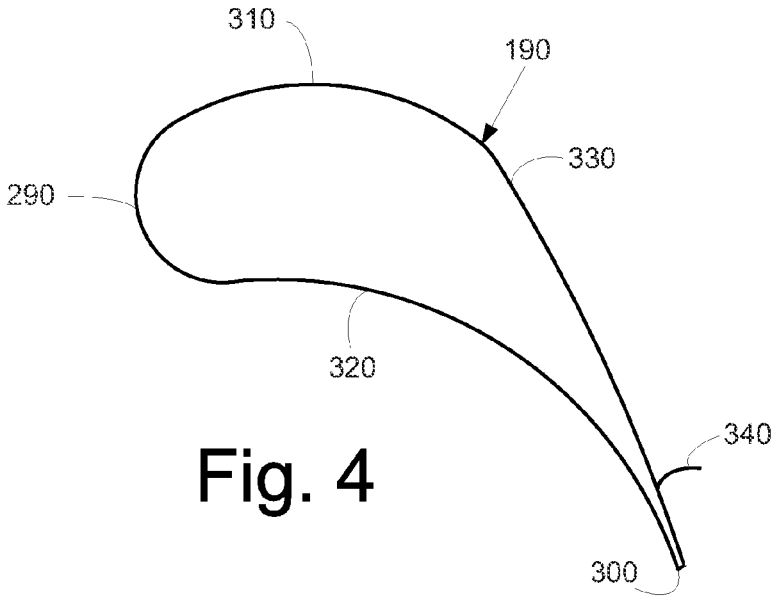
FIG. 4 is a schematic view of a portion of the turbine of FIG. 2 showing a bucket.

FIG. 3 shows a pair of last stage nozzles 180. Each nozzle 180 includes a leading end 250, a trailing end 260, a suction side 270, and a pressure side 280. Likewise, FIG. 4 shows an example of the last stage bucket 190. The last stage bucket 190 also includes a leading end 290, a trailing end 300, a suction side 310, and a pressure side 320. The nozzles 180 and the buckets 190 may be arranged in circumferential arrays in each of the turbine stages. Any number of the nozzles 180 and the buckets 190 may be used. The nozzles 180 and the buckets 190 may have any size or shape. Other components and other configurations may be used herein.

As described above, any number of operational parameters may be optimized for improved turbine and diffuser performance. For example, the last stage flow path 220 may be considered. As described above, the last stage flow path 220 may be defined by the annulus 230 formed by the outer casing 240 of the turbine 100. Likewise, the inlet 200 of the diffuser 210 thus may match the characteristics of the annulus 230 for improved diffuser performance. Several of the last stage variables may include a relative Mach number, a pressure ratio, a radius ratio, a reaction, an unguided turning angle, and throat distribution ranges. Other also variables may be considered herein.

For example, designing the last stage 170 to result in a low bucket hub inlet relative Mach number, whether through a reduced pressure ratio, an increased annulus 230, or otherwise, may increase overall efficiency. In this example, the low bucket hub inlet relative Mach number may be less than about 0.7 or so. Such a relative Mach number should maintain reasonable hub conversions and performance. Once the last stage configuration is set, the throat distribution may be optimized for the inlet profile of the diffuser.

Specifically, the pressure ratio may be determined across the turbine 100 as a whole or across the nozzle 180 or the bucket 190 of the last stage 170. The overall pressure ratio may be about 20 or more. The radius ratio may consider a hub radius from the rotor 196 to the hub 192 and a tip radius from the rotor 196 to the tip 194 of the last stage bucket 190. In this example, the radius ratio may be about 0.4 to about 0.65. The degree of hub reaction considers the pressure ratio of the last stage bucket 190 with respect to the pressure ratio of the last stage 180. In this example, the degree of reaction on the hub side may be greater than about zero (0) so as to maintain reasonable loading about the hub. The unguided turning angle may be defined as the amount of turning over the rear portion of the bucket 190 from a throat 330 to the trailing end 300. In this example, the unguided turning angle may be less than about twenty degrees (20°) so as to keep shock loss at reasonable levels. A further a parameter may be an exit angle ratio 350. The exit angle ratio 350 may be defined as a tip side exit angle with respect to a hub side exit angle of the last stage nozzle 180. In this example, the exit angle ratio may be less than about one (1). Other variables and parameters may be considered herein so as to result in varying configurations.

Figure 5:
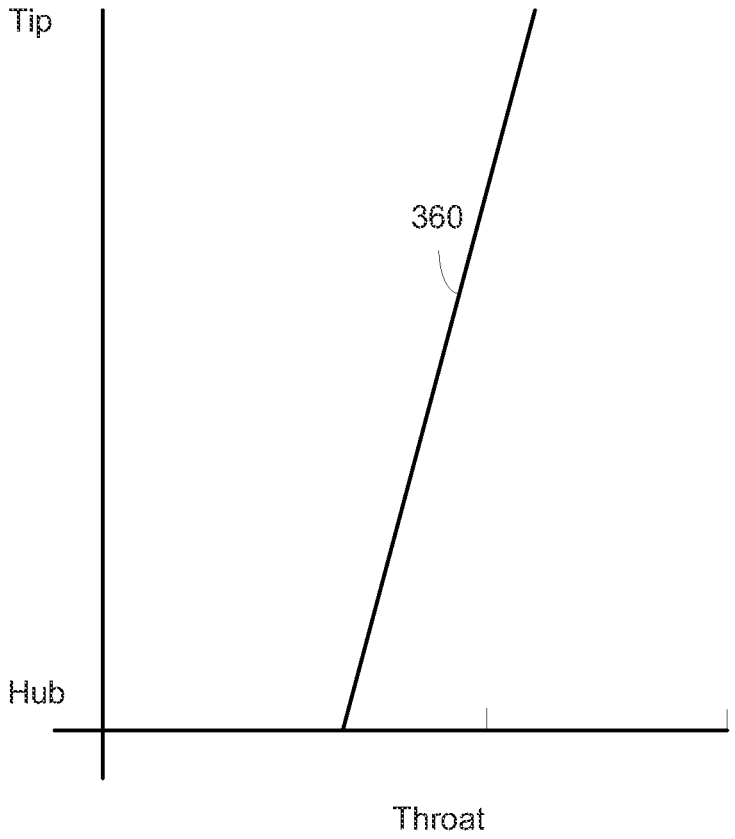
FIG. 5 is a chart showing a nozzle gauging ratio across a nozzle span of the turbine of FIG. 2.

A further parameter may be a throat distribution or a gauging ratio 360 of the last stage nozzle 180. Specifically, a tip side gauging is compared to a hub side gauging. The gauging ratio 360 may be considered by evaluation of a throat length 370 and a pitch 380 between adjacent nozzles 180. The throat length 370 is the distance between the trailing end 360 of a first nozzle 180 to the suction side 270 of a second nozzle 180. The pitch 380 may be defined as the distance between the leading edge 250 of the first nozzle 180 and the leading edge 250 of the second nozzle 180. (The distance between the trailing ends 260 also may be used herein.) As is shown in FIG. 5, the gauging of the last stage nozzle 180 herein increases from the tip side to the hub side, i.e., the throat is more open at the tip and closed at the hub. Specifically, the gauging ratio 360 may be greater than about 0.95 so as to produce a more uniform radial work distribution and flatter diffuser inlet profiles.

The last stage 170 thus may have a low bucket hub inlet relative Mach number through either a reduction in the pressure ratio or an increase in the annulus area. The bucket throat distribution or gauging ratio 360 then can be set to achieve an ideal profile for the diffuser inlet 200. Specifically, the throat may be more open at the tip and closed at the hub. Such an arrangement thus optimizes both turbine and diffuser performance so as to improve overall system performance. This configuration thus may be unique given that gauging ratios often are smaller, i.e., the throat may be less open at the tip and more open at the hub.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A gas turbine engine, comprising:
a turbine, the turbine comprising:
a plurality of last stage buckets;
a plurality of last stage nozzles, wherein a gauging of the last stage nozzles increases from a hub side to a tip side of the last stage nozzles; and
a radius ratio of 0.4 to 0.65; and
a diffuser positioned downstream of the turbine.

2. The gas turbine engine of claim 1, wherein the gauging of the last stage nozzles comprises a ratio of a throat length of the last stage nozzles to a pitch of the last stage nozzles.

3. The gas turbine engine of claim 1, wherein the turbine is configured to result in a bucket hub inlet relative Mach number of less than 0.7.

4. The gas turbine engine of claim 1, wherein the turbine is configured to result in a pressure ratio of 20 or more.

5. The gas turbine engine of claim 1, wherein the radius ratio comprises a ratio of a hub radius from a rotor to a hub of a last stage bucket and a tip radius from the rotor to a tip of the last stage bucket.

6. The gas turbine engine of claim 1, wherein the turbine is configured to result in a degree of hub reaction of greater than zero (0).

7. The gas turbine engine of claim 6, wherein the degree of hub reaction comprises a pressure ratio of the last stage bucket and a pressure ratio of the last stage nozzle.

8. The gas turbine engine of claim 1, wherein the turbine comprises an unguided turning angle of less than twenty degrees(20°).

9. The gas turbine engine of claim 8, wherein the unguided turning angle comprises an angle of the last stage bucket from a throat of the last stage bucket to a trailing end of the last stage bucket.

10. The gas turbine engine of claim 1, wherein the turbine comprises an exit angle ratio of less than one (1).

11. The gas turbine engine of claim 10, wherein the exit angle ratio comprises a ratio of a tip side exit angle and a hub side exit angle of the last stage nozzle.

12. The gas turbine engine of claim 1, wherein the turbine comprises a last stage flow path defined therein.

13. The gas turbine engine of claim 12, wherein the turbine comprises an annulus defining the last stage flow path, and wherein the diffuser comprises a diffuser inlet positioned adjacent the annulus.

14. A gas turbine engine, comprising:
a last stage of a turbine, the last stage of the turbine comprising:

a plurality of last stage buckets;

a plurality of last stage nozzles, wherein a gauging of the last stage nozzles increases from a hub side to a tip side of the last stage nozzles;

a last stage flow path therethrough; and a radius ratio of 0.4 to 0.65; and a diffuser positioned downstream of the last stage of the turbine.

15. The gas turbine engine of claim 14, wherein the gauging of the last stage nozzles comprises a ratio of a throat length of the last stage nozzles to a pitch of the last stage nozzles.

16. The gas turbine engine of claim 14, wherein the turbine is configured to result in a bucket hub inlet relative Mach number of less than 0.7 and a pressure ratio of 20 or more.

17. The gas turbine engine of claim 14, wherein the turbine comprises an unguided turning angle of less than twenty degrees(20°), and an exit angle ratio of less than one (1), and wherein the turbine is configured to result in a degree of hub reaction of greater than zero (0).

18. A gas turbine engine, comprising:

a last stage of a turbine, the last stage of the turbine comprising:

a plurality of last stage buckets, a plurality of last stage nozzles, wherein a gauging of the last stage nozzles increases from a hub side to a tip side of the last stage nozzles, a last stage flow path therethrough, a radius ratio of 0.4 to 0.65, an unguided turning angle of less than twenty degrees (20°), and an exit angle ratio of less than one (1), wherein the turbine is configured to result in a degree of hub reaction of greater than zero (0); and a diffuser positioned downstream of the last stage of the turbine.

19. The gas turbine engine of claim 18, wherein the gauging of the last stage nozzles comprises a ratio of a throat length of the last stage nozzles to a pitch of the last stage nozzles.

* * * * *

UNITED STATES PATENT AND TRADEMARK OFFICE

CERTIFICATE OF CORRECTION

PATENT NO. : 8,998,577 B2
APPLICATION NO. : 13/288057
DATED : April 7, 2015
INVENTOR(S) : Ross James Gustafson et al.

It is certified that error appears in the above-identified patent and that said Letters Patent is hereby corrected as shown below:

In the Claims,

In Column 4, Line 49 (Claim 8, Line 3), change "degrees(20°)." to -- degrees (20°). --.

In Column 5, Line 18 (Claim 17, Line 3), change "degrees(20°)," to -- degrees (20°), --.

Signed and Sealed this
Twenty-first Day of July, 2015

Michelle K. Lee

Michelle K. Lee
*Director of the United States Patent and Trademark Office*